US006394373B1

(12) United States Patent
Morris

(10) Patent No.: US 6,394,373 B1
(45) Date of Patent: May 28, 2002

(54) SLOPED CUTTER KNIVES ON TUBE-TYPE ICE MAKER

(75) Inventor: William F. Morris, Raleigh, NC (US)

(73) Assignee: Morris & Associates, Raleigh, NC (US)

( * ) Notice: Subject to any disclaimer, the term of this patent is extended or adjusted under 35 U.S.C. 154(b) by 0 days.

(21) Appl. No.: 09/607,954

(22) Filed: Jun. 30, 2000

(51) Int. Cl.[7] ..... B02C 19/12
(52) U.S. Cl. ..... 241/92; 241/DIG. 17
(58) Field of Search ..... 241/DIG. 17, 92

(56) References Cited

U.S. PATENT DOCUMENTS 4,113,190 A * 9/1978 Fudman
4,778,117 A * 10/1988 Karg

* cited by examiner

*Primary Examiner*—Mark Rosenbaum

(74) *Attorney, Agent, or Firm*—Jacobson Holman, PLLC

(57) ABSTRACT

A rotating disc for cutting ice in an industrial ice maker includes a center mounting hole for rotatably mounting the disc in the ice maker. The round flat top surface having a plurality of triangularly shaped through holes. The base of the triangularly shaped through holes being equally spaced from the mounting hole. The base is also positioned near the outer edge. The disc has plurality of cutter knives with triangular shapes. Each of the plurality of cutter knives are securely fastened to the round flat top surface and fixedly positioned to nearly cover each of the triangularly shaped through holes. A slot remains and extends nearly from the mounting hole to the outer edge. There is a raised portion which forms a cutting edge and is positioned over the triangularly shaped hole and parallel with the slot. The cutting edge extends nearly from the mounting hole to the outer edge of the rotating disc. A back edge of the plurality of cutter knives is flush with the round top surface and forms a sloping surface connecting each cutting edge to each back edge so that when the ice is cut, the cut part falls through the slot and the other part slides down the sloping surface to the back edge and is ready to be cut again.

12 Claims, 3 Drawing Sheets

SLOPED CUTTER KNIVES ON TUBE-TYPE ICE MAKER

BACKGROUND OF THE INVENTION

1. Field of the Invention

The present invention relates to an apparatus for cutting ice. More specifically, the invention relates to an apparatus for cutting ice using a rotating disc positioned approximately one inch beneath an evaporator vessel tube sheet, particularly in connection with commercial and industrial ice making machines.

2. Related Art

Rotating ice cutter discs of ice making machines are built so that the discs have several cutter knives or blades mounted on the top surface of the disc. The blades are positioned in such a way that the cutting edge is adjusted to rotate just slightly, approximately one sixteenth of an inch, below the bottom face of the evaporator tube sheet. The blades cut off segments of the vertical ice pieces which drop onto the rotating disc. The ice maker works by having water circulating inside tubes in the evaporator vessel. The ice freezes on the inside wall of the tubes until only a small hole approximately one quarter inch in diameter remains. When a reverse cycle defrost is initiated, the defrosted vertical ice shafts defrost from the tubing walls and drop vertically onto the rotating disc spaced which is approximately one inch beneath the bottom face of the evaporator vessel tube sheet.

The rotating disc is designed in such a way as to have a hole or slot approximately the full size of the cutter knife in the disc under each knife for the ice that is cut to fall through as it is cut off, after which it slides down a chute to be discharged from the machine.

The evaporator vessel and the defrosted vertical ice pieces, in many cases, were up to 15 feet in length. The ice had to be cut into lengths of one and half inches. This required a substantial portion of the total ice making cycle just for the "chop time." During this chop time, the hot gas was also putting heat back into the evaporator which would unnecessarily extended that portion of the cycle and reducing the efficiency and capacity of the system. The heat that went in had to be pulled back out of the evaporator during the subsequent freezing cycle.

The vertical ice pieces must remain practically fixed at the moment they are being cut to give a "square" cutting face to the pieces. When the ice starts to fall again after each cut, this intermittent motion further adds to the time required for the cutting cycle.

The ice making is limited to the maximum RPM that the ice maker can turn the rotating disc by the maximum permissible peripheral speed of the disc before shattering of the ice cubes occurs.

Accordingly, there is little that can be done to shorten the total cycle time and improve efficiency other than to shorten defrost time and "chop time." But since the defrost is also continuing during the "chop time," it has been determined that one can shorten the total cycle time 2 minutes for every 1 minute one shortens the defrost and "chop time." This is due to the equal amount of freeze time which must be added to the cycle to compensate for any extension of the harvest cycle and the extra heat added back into the vessel that must be removed during the following freeze cycle.

In view of the stated operating criteria, about the most effective thing that can be done is to reduce total cycle time required. However, with the conventional cutter knife, to minimize the time that the ice is delayed in dropping after being cut would be difficult since the ice has to ride across the flat top of the conventional cutter knife that covers the hole in the rotating disc, before hitting the flat top surface of the rotating disc.

It is the solution to the foregoing and other problems to which the present invention is directed.

SUMMARY OF THE INVENTION

It is therefore a primary object of the invention to provide a rotating disc with a sloped cutter knife for reverse cycle harvest in an ice maker.

Another object of the invention is to provide the rotating disc with an outer edge and a round flat top surface having a plurality of triangularly shaped through holes.

It is another object of the invention to have a plurality of cutter knives with triangularly shapes, each securely fastened to the round flat top surface of the disc and fixedly positioned to nearly cover the triangularly shaped through holes.

Another object of the invention is to ensure each of the triangularly shaped through holes forms a slot, and the formed slot extends nearly from the center mounting hole to the outer edge of the rotating disc.

It is another object of the invention to provide each the plurality of cutter knives with a raised portion, and the raised portion being positioned over the triangularly shaped hole and parallel with the slot.

Another object of the invention is to provide a plurality of cutting edges for cutting ice in the ice maker, wherein each cutting edge forms the raised portion of the cutter knives and is parallel with each corresponding slot.

A further object of the invention is to provide a back edge for the plurality of cutter knives which extends nearly from the center mounting hole to the outer edge of the rotating disc.

It is an object of the invention to make the back edge of each of the cutter knives flush with the round top surface and securely fastened to the round top surface.

Another object of the invention is make, on each of the cutter knives, a sloping surface which connects each cutting edge to each back edge.

These and other objects of the invention are achieved by the present invention which is directed to a plurality of cutting knives or blades mounted on a rotating disc for cutting ice in an industrial ice maker.

More specifically, the rotating disc has a center mounting hole for rotatably mounting the disc in the ice maker and an outer edge. The round flat top surface of the disc includes a plurality of triangularly shaped through holes. The base of each of the triangularly shaped through holes is equally spaced from center mounting hole and positioned near the outer edge. The invention is directed to a plurality of cutter knives having triangular shapes. Each of the plurality of cutter knives is securely fastened to the round flat top surface and fixedly positioned to nearly cover each of the triangularly shaped through holes. A space or slot is formed in the gap or portion not covered by the cutting knife. The formed slot extends nearly from the center mounting hole to the outer edge. There remains a raised portion which includes the cutting edge. The rest of the cutter knife is a sloping surface which is connected or welded to the top surface of the rotating disc. As the ice falls, it is cut. The cut portion falls through the slot and down a chute. The remaining portion slides down the sloping surface and, upon hitting the top surface of the rotating disc, the ice is ready to be cut.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is better understood by reading the following Detailed Description of the Preferred Embodiment with reference to the accompanying drawing figures, in which like reference numerals refer to like elements throughout, and in which.

DESCRIPTION OF THE PREFERRED EMBODIMENT

Figure 1:
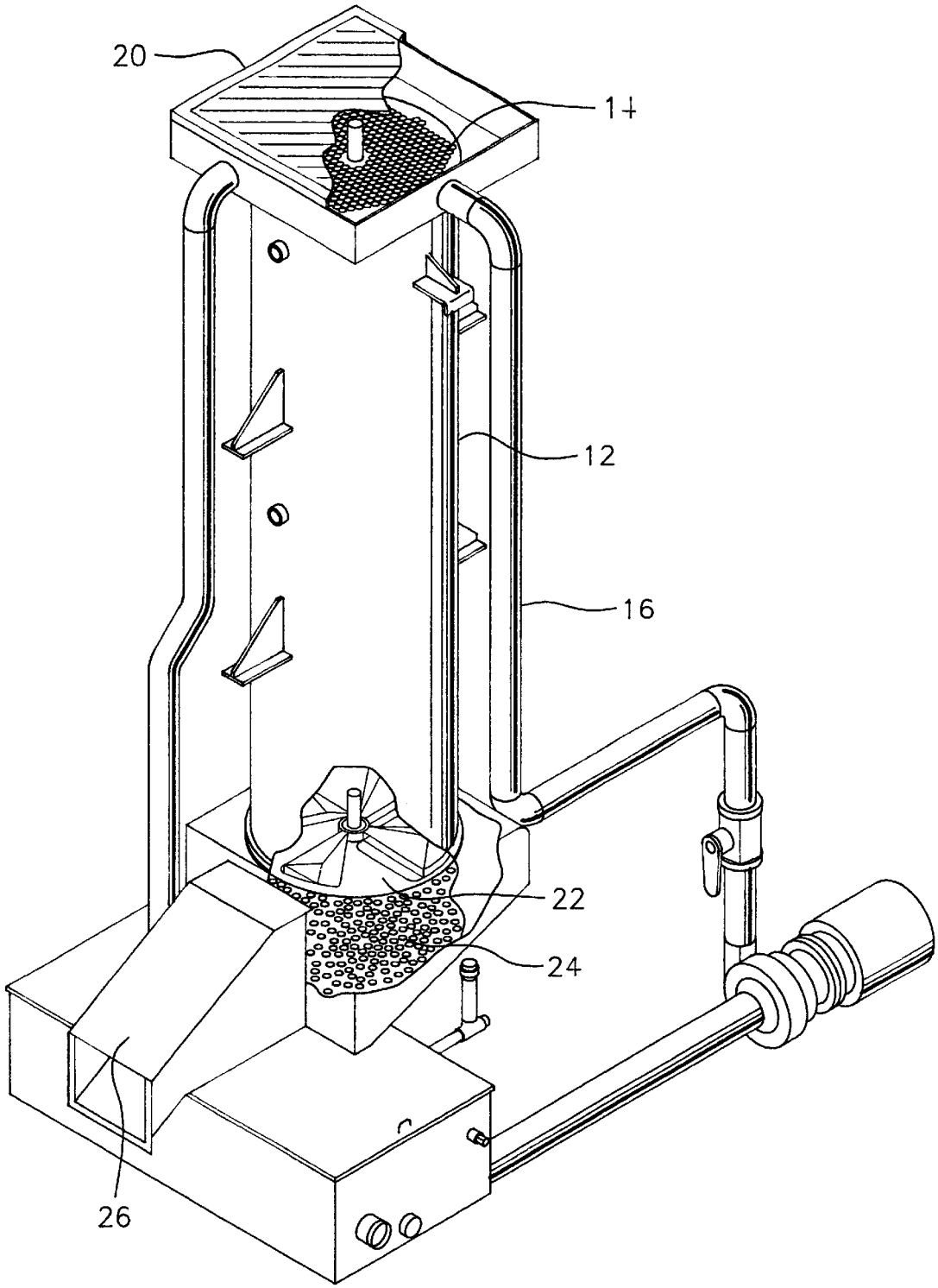
FIG. 1 is a perspective view of an industrial ice maker of the kind that would utilize the present invention.

In describing preferred embodiment of the present invention illustrated in the drawings, specific terminology is employed for the sake of clarity. However, the invention is not intended to be limited to the specific terminology so selected, and it is to be understood that each specific element includes all technical and functional equivalents which operate in a similar manner to accomplish a similar purpose. It is also important to note that like parts are referenced by the same reference numeral throughout.

Referring now to FIG. 1, there is shown a reverse cycle defrost ice-maker system, generally designated as 10, embodying the present invention. The ice maker system 10 includes a generally cylindrical housing or vessel 12 enclosing a compressor, an electrical and mechanical control circuitry (not shown) and a plurality of ice maker evaporators, for example elongated evaporator tubes 14.

The ice maker 10 works by having water pumped from a water supply 16 into a top pan 20. The water circulates inside tubes 14 in the evaporator vessel 12. The ice freezes on the inside wall of the tubes until only a small hole approximately one quarter inch in diameter remains. When a reverse cycle defrost is initiated, the defrosted vertical ice shafts defrost from the tubing walls and drop vertically onto a rotating disc 22 which is rotatably mounted and spaced approximately 1" beneath the bottom face of the evaporator vessel tube sheet (not shown).

The evaporator vessel 12 and the defrosted vertical ice pieces, in many cases, are up to 15 feet in length. The ice 24 has to be cut into lengths of one to one and a half inches. This requires a substantial portion of the total ice making cycle just for the "chop time." During this chop time, the hot gas is also putting heat back into the evaporator which unnecessarily extends that portion of the cycle and reduces the efficiency and capacity of the system. The heat that goes in has to be pulled back out of the evaporator during the subsequent freezing cycle.

Figure 2:
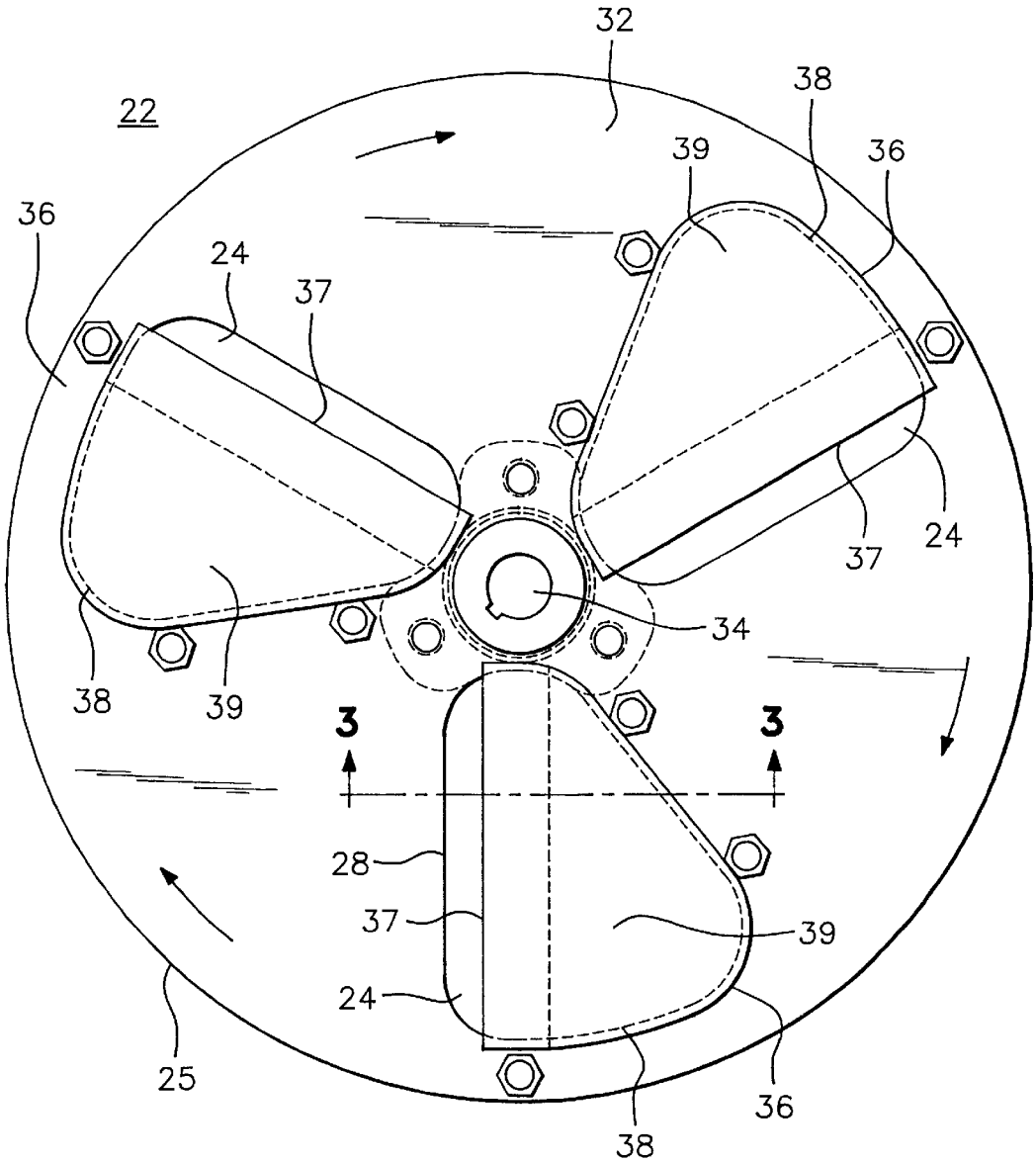
FIG. 2 (PRIOR ART)
FIG. 2 is a top plan view of a rotating disc with cutter knife blades as utilized in the prior art.
Figure 3:
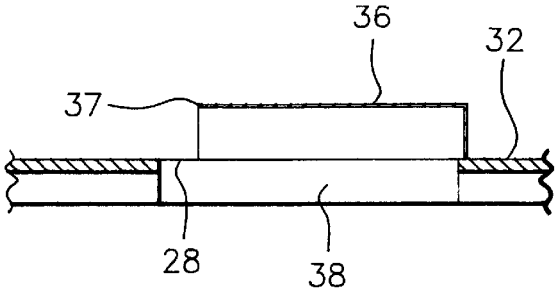
FIG. 3 (PRIOR ART)
FIG. 3 is a side view taken along line 3—3 of FIG. 2 to illustrate the cutter knife blade as utilized in the prior art.

FIGS. 2 and 3 illustrate the design of a conventional rotating disc, generally indicated by reference numeral 22. The rotating disc 22 has an outer edge 25 and a flat top surface 32. In the center of the top surface 32, is a center mounting hole 34 for mounting the rotating disc 22 to the evaporator. Securely mounted on the flat top surface 32 of the rotating disc 22 are a plurality of cutter knives or blades, generally referred to with 36. The cutter knives 36 are parallel to the top surface 32 of the rotating disc 22, with the entire area of the rotating disc 22 under each cutter knife 36 being cut out in the general shape of a triangle to form triangularly shaped through holes 38. Each triangularly shaped through hole 38 allows the ice 24 to discharge after being cut. The ice 24 then proceeds out the chute 26.

The rotating disc 22 is built so that the disc 22 has several cutter knives or blades 36 mounted on the top surface 32 of the rotating disc 22. The conventional cutter knives 36 are positioned in such a way that a cutting edge 37 is adjusted to rotate just slightly, approximately one sixteenth an inch, below the bottom face of the evaporator tube sheet. The cutter knives 36 cut off segments of the vertical ice pieces which drop onto the rotating disc 22.

The vertical ice pieces must remain practically fixed at the moment they are being cut to give a "square" cutting face to the pieces. When the ice starts to fall again, after each cut, this intermittent motion further adds to the time required for the cutting cycle.

The maximum RPM of the rotating disc 22 on which the cutter knives 36 are mounted is limited by the permissible peripheral speed of the disc before shattering of the ice cubes occurs.

An example of a typical time cycle on a reverse cycle ice maker 10 is as follows for a one inch diameter ice, cut into approximately one and a quarter inch segments from a 15 foot tall evaporator with 3 conventional design cutter knives 36 on the disc 22 rotating at 34½ RPM.

9 minutes freeze time 1 minute defrost time 3 minutes chop time 13 minutes total cycle time Accordingly, there is little that can be done to shorten the total cycle time and improve efficiency other than to shorten defrost time and "chop time." But since the defrost is also continuing during the "chop time," it has been determined that one can shorten the total cycle time 2 minutes for every 1 minute one shortens the defrost and "chop time." This is due to the equal amount of freeze time which must be added to the cycle to compensate for any extension of the harvest cycle and the extra heat added back into the vessel 12 that must be removed during the next freeze cycle.

In view of the previously set forth operating criteria, about the most effective thing that can be done is to reduce total cycle time required. However, with the conventional cutter knife 36 mounted on the rotating disc 22 as shown in FIGS. 2 and 3, to minimize the time that the ice is delayed in dropping after being cut would be difficult since the ice has to ride across the flat top 39 of the conventional cutter knife 36 that covers the hole 38 in the rotating disc 22, before hitting the flat top surface 32.

Figure 4:
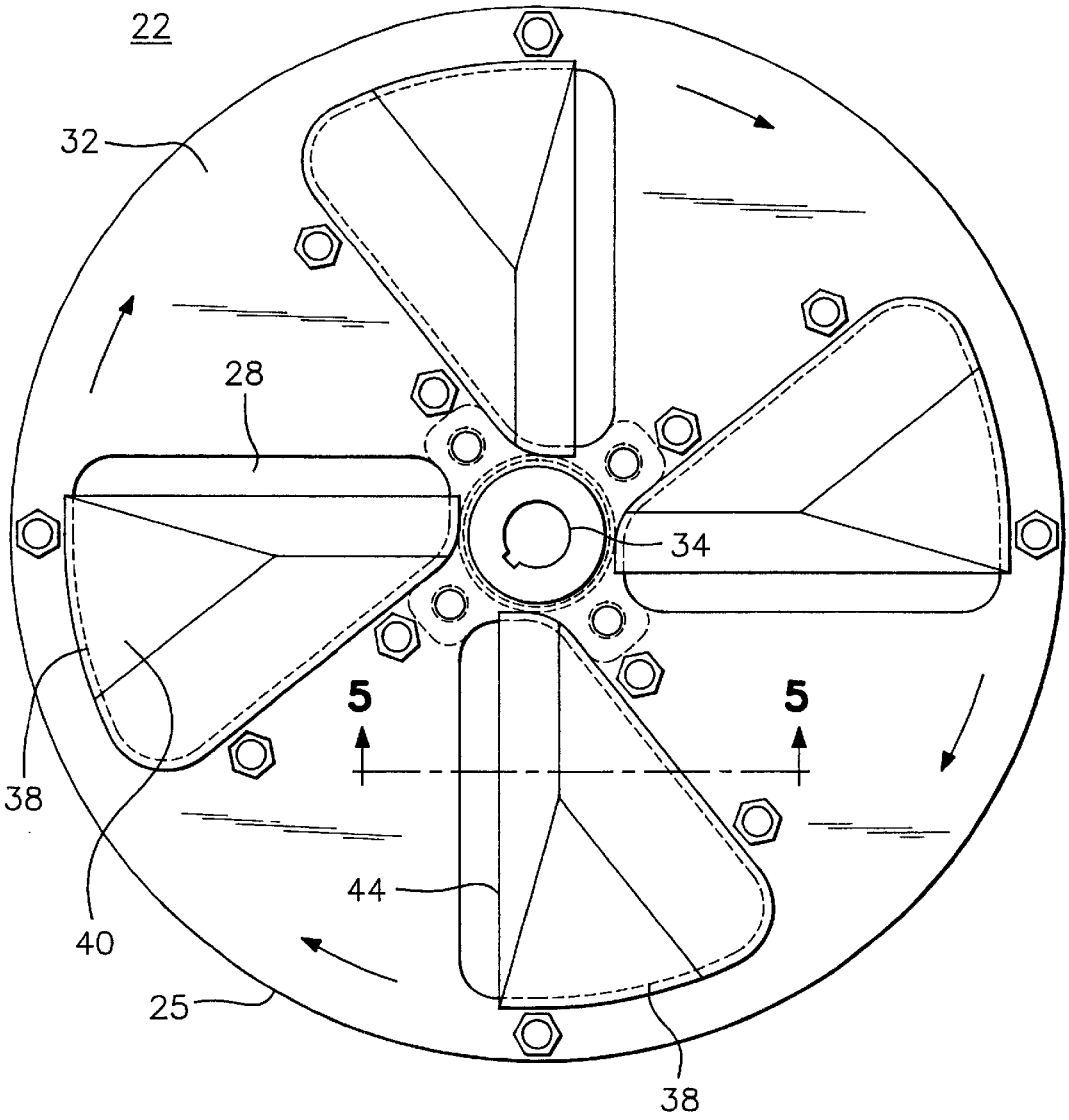
FIG. 4 is a top plan view of a rotating disc with sloped cutter knife blades as utilized in the present claimed invention.
Figure 5:
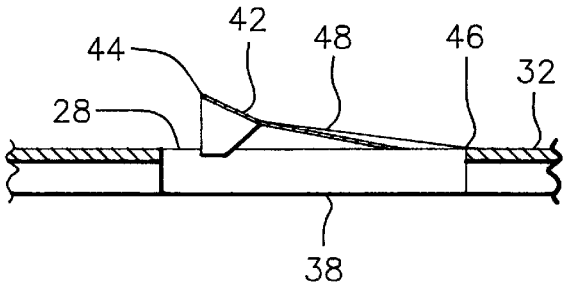
FIG. 5 is a side view taken along line 5—5 of FIG. 4 to illustrate the sloped cutter knife blade as utilized in the present claimed invention.

Referring now to the present invention as illustrated in FIGS. 4 and 5, a decrease in the total time can be accomplished by sloping the top of the cutter knife from the cutting edge which is one and a half inches above the rotating disc sloped down to where it is level with the top of the rotating disc at the back end of the opening in the rotating disc (which is the back end of the knife).

The rotating disc 22 as shown in FIGS. 4 and 5 is similar to that as shown in FIGS. 2 and 3 wherein the disc 22 includes a center mounting hole 34 for rotatably mounting the disc 22 in the ice maker 10 and the disc 22 has an outer edge 23. The round flat top surface 32 of the disc 22 includes a plurality of triangularly shaped through holes 38. The through hole 38 has a base which is closest to the outer edge 25 and an apex which is positioned near the mounting hole 34. Each base of each triangularly shaped through hole 38 is equally spaced from the center mounting hole 34 and positioned near the outer edge 25.

As shown in FIG. 4, fixedly mounted on the flat top surface 32 of the rotating disc 22 are a plurality of cutter knives 40 wherein the invention lies. The Figure shows four cutter knives 40, but it is believed that any number of cutter knives could be contemplated. The cutter knives 40 have triangular shapes, similar to the triangularly shaped through holes 38. Each of the cutter knives 40 are fixedly positioned to nearly cover each of the triangularly shaped through holes 38. After the through hole 38 is nearly covered by the triangularly shaped cutter knife 40, the slot 28 is formed, since part of the cutter knife 40 does not cover that part of the triangularly shaped through hole 38. The formed slot 28 extends nearly from the mounting hole 34 to the outer edge 25 of the rotating disc 22. The slot 28 allows the ice 24 to drop through and out the chute 26. Each of the cutter knives 40 has a raised portion 42 positioned over the triangularly shaped hole 38 and parallel with the slot 28. It is approximately one and a half inches above the flat top surface 32 of the disc 22. The height of the raised portion 42 matches the size of the ice segments 24.

Referring to FIG. 5, which is a section taken along line 5—5 of FIG. 4, specifics of the sloped cutter knife 40 can be seen. To actually cut the ice without cracking, there is a cutting edge 44. The cutting edge 44 is formned on or as part of the raised portion 42 and it is parallel with the slot 28. As shown in FIG. 5, the cutter knife 40 includes a back edge 46. The back edge 46 extends nearly from the mounting hole 34 to the outer edge 25 of the rotating disc 22. Also, the back edge 46 of each of the cutter knives 22 is flush with the flat top surface 32 and securely fastened to the flat top surface 32 of the rotating disc 22. To connect the cutting edge 44 and raised portion 42 to the back edge 46 of the cutter knife 22, there is a sloping surface 48.

The sloped cutter knife 40 mounted on the flat top surface 32 of the rotating disc 22, for all practical purposes, allows the ice to drop almost continuously from the moment it is cut. This increases the portion of the complete revolution of the rotating disc 22. The sloped cutter knife 40 increases the time the vertical ice is actually dropping from approximately 50% to 80% of the revolution. This in turn reduces "chop time" from 240 seconds to 150 seconds for the total cycle. A savings of 90 seconds which is also saving hot gas time meaning an equal savings of 90 seconds additional on freeze time for a total savings of 180 seconds or 3 minutes total in a full cycle which originally was 13 minutes with the conventional knife 36 for a new cycle time of 10 minutes with the new design sloped cutter knife 40.

An example of a time cycle on a reverse cycle ice maker 10 using the sloped cutter knives 40 is as follows—for the same one inch diameter ice, cut into approximately one and half inch segments from a 15 foot tall evaporator using the sloped cutter knives 40 on the disc rotating at 34½ RPM is as follows:

7½ minutes freeze time 60 seconds defrost time 90 seconds "chop time"

10 minutes total time

This amounts to an increase in efficiency and capacity of 30% using the sloped cutter knife 40 and all with no increase in refrigeration capacity or horsepower or freezing surface.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims. Accordingly, it is therefore to be understood that, within the scope of the appended claims and their equivalents, the invention may be practiced otherwise than as specifically described.

What is claimed is:

1. A rotating disc for use in an industrial ice making machine to cut ice into ice cubes, comprising:

a round flat top surface having a center and an outer edge, and at least one through hole extending outwardly from said center to nearly said outer edge;

at least one cutter knife securely fastened to said round flat top surface and fixedly positioned to nearly cover said at least one through hole to form a slot, said cutter knife having a raised portion, said raised portion positioned over said at least one through hole and parallel with said slot at a predetermined height, said predetermined height matching said ice cubes;

a cutting edge for cutting said ice into said ice cubes, said cutting edge forming said raised portion to be parallel with said slot and extended from said center to nearly said outer edge;

a back edge being part of said at least one cutter knife and flush with said round top surface for securely fastening said at least one cutter knife to said round top surface; and a sloping surface for connecting said cutting edge to said back edge and for accelerating a descent of said ice to said round flat top surface.

2. The rotating disc of claim 1, wherein said rotating disc having a center mounting hole for rotatably mounting said disc in said industrial ice making machine.

3. The rotating disc of claim 2, wherein said disc further comprising:

a plurality of triangularly shaped through holes, each of said triangularly shaped through holes having a base and an apex wherein said apex being equally spaced from said mounting hole and said base positioned near said outer edge of said rotating disc.

4. The rotating disc of claim 3, wherein said disc comprising:

a plurality of cutter knives having triangular shapes, each said plurality of said cutter knives securely fastened to said round flat top surface and fixedly positioned to nearly cover each said triangularly shaped through holes to form said slot, and said formed slot extending nearly from said mounting hole to said outer edge.

5. The rotating disc of claim 4, wherein said disc comprising:

a plurality of cutting edges for cutting ice in said industrial ice making machine.

6. The rotating disc of claim 5, wherein said back edge is part of said plurality of cutter knives and extends nearly from said mounting hole to said outer edge of said rotating disc, said back edge of each said plurality of cutter knives is flush with said round top surface and is securely fastened to said round top surface.

7. The rotating disc of claim 6, wherein said sloping surface receives said ice and permits said ice to slide down said sloping surface.

8. The rotating disc of claim 1, wherein said predetermined height of said raised portion is approximately one inch.

9. A rotating disc for cutting ice into ice cubes in an industrial ice maker, said rotating disc having a center mounting hole for rotatably mounting said disc is said ice maker and outer edge, comprising:

a round flat top surface having a plurality of triangularly shaped through holes, each base of said triangularly shaped through holes being equally spaced from said mounting hole and positioned near said outer edge;

a plurality of cutter knives having triangular shapes, each said plurality of said cutter knives securely fastened to said round flat top surface and fixedly positioned to nearly cover each said triangularly shaped through holes to form a slot, said formed slot extending nearly from said mounting hole to said outer edge, each said plurality of cutter knives having a raised portion, said raised portion positioned over said triangularly shaped hole and parallel with said slot at a predetermined height, said predetermined height matching said ice cubes;

a plurality of cutting edges for cutting said ice in said ice maker into said ice cubes, each said cutting edge forming said raised portion of one of said plurality of cutter knives and being parallel with each said slot; and a sloping surface for connecting each said cutting edge to said top surface of said disc and for accelerating a descent of said ice from said cutting edge to said flat top surface.

10. The rotating disc for cutting ice in an industrial ice maker as claimed in claim 9, wherein each said plurality of cutter knives further comprising:

a back edge being part of each said plurality of cutter knives and extending nearly from said mounting hole to said outer edge of said rotating disc, said back edge of each said plurality of cutter knives being flush with said round top surface and securely fastened to said round top surface.

11. The rotating disc for cutting ice in an industrial ice maker as claimed in claim 9, wherein said predetermined height of said raised portion is approximately one inch.

12. A rotating disc for cutting ice into ice cubes in an industrial ice maker, said rotating disc having a center mounting hole for rotatably mounting said disc in said ice maker and an outer edge, comprising:

a round flat top surface having a plurality of triangularly shaped through holes, each base of said triangularly shaped through holes being equally spaced from said mounting hole and positioned near said outer edge;

a plurality of cutter knives having triangular shapes, each said plurality of said cutter knives securely fastened to said round flat top surface and fixedly positioned to nearly cover each said triangularly shaped through holes to form a slot, said formed slot extending nearly from said mounting hole to said outer edge, each said plurality of cutter knives having a raised portion, said raised portion positioned over said triangularly shaped hole and parallel with said slot at a predetermined height, said predetermined height matching said ice cubes;

a plurality of cutting edges for cutting said ice in said ice maker into said ice cubes, each said cutting edge forming said raised portion of one of said plurality of cutter knives and being parallel with each said slot;

a back edge being part of said plurality of cutter knives and extending nearly from said mounting hole to said outer edge of said rotating disc, said back edge of each said plurality of cutter knives being flush with said round top surface and securely fastened to said round top surface; and a sloping surface on each said plurality of cutter knives, said sloping surface connecting each said cutting edge to each said back edge and for accelerating a descent of said ice from said cutting edge to said flat top surface.

* * * * *